US009308550B1

(12) United States Patent
Hajianpour

(10) Patent No.: US 9,308,550 B1
(45) Date of Patent: Apr. 12, 2016

(54) LOTION APPLICATOR WITH A FILLABLE ROLLER

(75) Inventor: Zoya Hajianpour, Fort Lauderdale, FL (US)

(73) Assignee: Zoya, Inc., Fort Lauderdale, FL (US)

( * ) Notice: Subject to any disclaimer, the term of this patent is extended or adjusted under 35 U.S.C. 154(b) by 2151 days.

(21) Appl. No.: 11/235,885

(22) Filed: Sep. 27, 2005

(51) Int. Cl.
*B05C 1/00* (2006.01)
*B05C 17/00* (2006.01)
*B05C 17/03* (2006.01)

(52) U.S. Cl.
CPC ..... *B05C 17/0308* (2013.01)

(58) Field of Classification Search
USPC ..... 401/196, 197, 208, 219, 220; 15/230.11
See application file for complete search history.

(56) References Cited

U.S. PATENT DOCUMENTS 2,563,048 A * 8/1951 Emanuel et al. ..... 401/197
2,735,128 A * 2/1956 Adams ..... 15/230.11
2,743,469 A * 5/1956 Ditch ..... 401/197
2,766,603 A * 10/1956 Zelkowitz ..... 68/213
3,702,739 A 11/1972 Rentfrow
4,143,668 A 3/1979 Duval et al.
4,334,416 A * 6/1982 Turano ..... 68/213
4,735,522 A 4/1988 Myun-Sik
D337,856 S 7/1993 Butler et al.
5,966,902 A * 10/1999 Korycki ..... 53/397
6,742,950 B1 * 6/2004 Coombs ..... 401/23
D497,451 S 10/2004 Hajianpour

* cited by examiner

*Primary Examiner* — Huyen Le
(74) *Attorney, Agent, or Firm* — Ronald V. Davidge

(57) ABSTRACT

An applicator for applying a lotion, such as a sunscreen, to the skin includes a handle attached to an axle and a roller mounted to turn on the axle. The roller includes a housing having a central cavity holding the lotion and a number of holes extending between the central cavity and a cylindrical peripheral surface of the housing, which is covered with a porous elastomeric material through which the lotion is evenly applied to the skin. A cover is provided to minimize evaporation and contamination of the lotion during storage of the roller. The roller may be removed from the applicator for storage in a cover formed as a canister, or a clamshell cover may be closed over the roller in place on the applicator.

9 Claims, 2 Drawing Sheets

FIG. 1
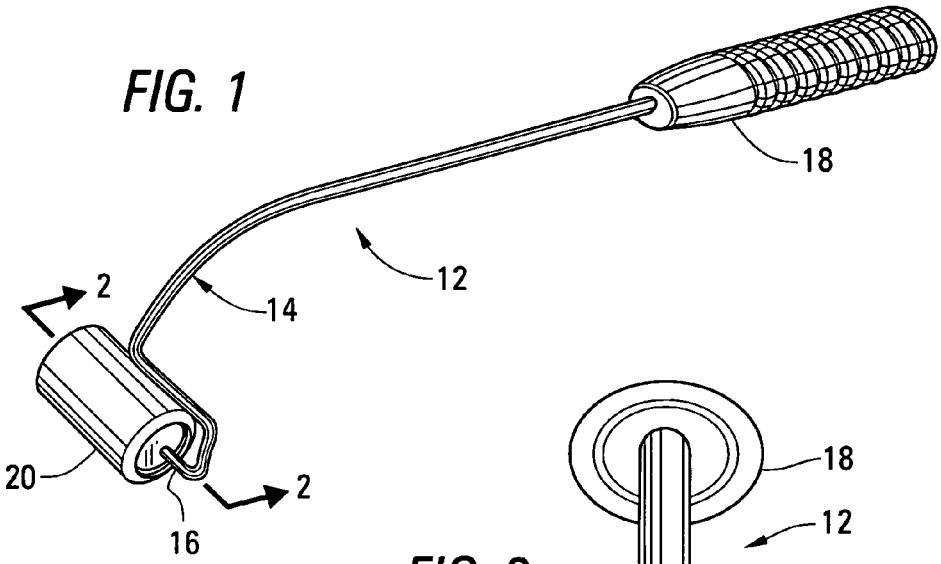
FIG. 2
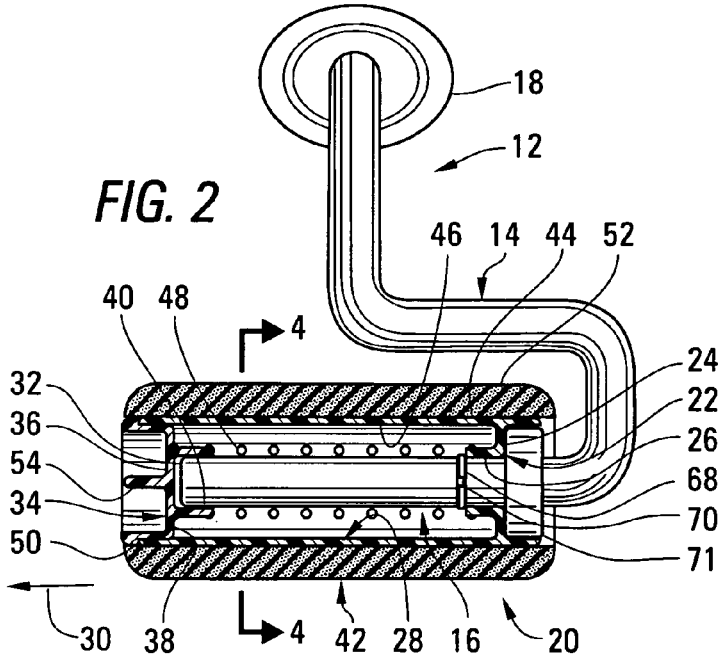
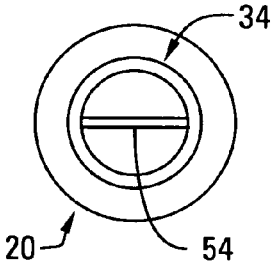
FIG. 3
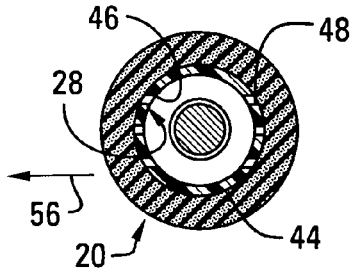
FIG. 4
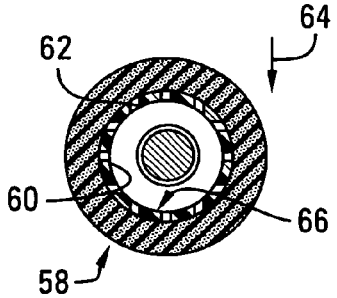
FIG. 5

LOTION APPLICATOR WITH A FILLABLE ROLLER

BACKGROUND OF THE INVENTION

1. Field of the Invention

This invention relates to a device for applying a lotion to the skin and, more particularly, to such a device including a roller for the smooth application of a lotion, such as a sunscreen.

2. Summary of the Background Art

The patent literature includes a number of descriptions of paint rollers in which paint moves from a reservoir inside the roller into a covering over the roller for application to a surface. For example, U.S. Pat. No. 4,735,522 describes a painting roller having a cylinder with peripheral holes, covered by a cloth brush, with paint storage within the cylinder and at least one injection hole at the end for filling the paint storage. U.S. Pat. No. 3,702,739 describes a painting roller having a porous cover over a cylinder with peripheral holes. The handle includes a hollow chamber filled with paint, pressurized by a plunger, which is fed through a hollow tube forming the frame holding the roller into the cylinder.

Other patents describe rollers for use in the application of cosmetics or lotions. For example, U.S. Pat. No. 4,143,608 describes a roller-type cosmetic applicator featuring a cap of a T-configuration adapted to fit on the outlet of a product container. An axle bearing extends through a cylindrical bearing element to support rollers at opposite ends of the axle. The product is distributed through cavities at each side of the cylindrical bearing element and through channels extending outward from the cavities, to be rolled onto the skin with the aid of the rollers. U.S. Design Pat. Nos. 337,856 and 497,451 each show a suntan lotion dispenser including a roller mounted on a handle, with U.S. Design Pat. No. 337,856 additionally showing a cover that can be placed over the roller.

What is needed is an applicator including a hollow roller for holding a lotion, such as a sunscreen lotion, and for applying the lotion through a porous elastomeric cover material extending around a periphery of the roller. Additionally, what is needed is a clamshell cover to be closed over the roller in such an applicator, or a means for easily removing the roller from the applicator so that the roller can be stored within a canister to minimize the evaporation or contamination of lotion held within the roller and within its porous cover.

SUMMARY OF THE INVENTION

According to one aspect of the invention apparatus is provided for applying a lotion, with the apparatus including a frame, a roller housing, an outer bearing, an outer end cap and a roller cover. The frame includes an axle and a handle extending away from the axle. The roller housing includes an inner end cap forming an inner bearing rotatably mounted on the axle and a cylinder extending in an outward direction from the inner end cap to an outer end of the roller housing. The cylinder includes a peripheral surface, a central cavity, and a plurality of holes extending between the peripheral surface and the central cavity. The outer bearing is rotatably mounted on the axle to turn with the roller housing. The outer bearing is spaced along the axle in the outward direction from the inner bearing. The outer end cap is fastened to the outer end of the roller housing and removable therefrom to expose the central cavity. The roller cover, which is composed of a porous elastomeric material, is stretched over the outer surface of the cylinder.

In a first embodiment, the axle includes an end disposed within the roller housing, and the outer end cap includes an outer surface, extending over the end of the axle and an inner surface forming the outer bearing.

In a second embodiment, the roller housing additionally includes a central bearing structure extending in the outward direction to cover the axle within the central cavity and forming the outer bearing; and the axle includes an end disposed within the central bearing structure.

According to another aspect of the invention apparatus is provided for applying a lotion, with the apparatus including a frame, a roller, a detent ring and a storage canister. The frame includes an axle and a handle extending away from the axle. The roller, which includes a housing having a cylindrical peripheral surface and a porous cover extending over the cylindrical peripheral surface, is removably attached to rotate on the axle. The detent ring releasably holding the roller on the axle. The storage canister includes a storage cavity for holding the roller, with the roller removed from the axle, and a storage end cap removably attached to cover the storage cavity.

According to yet another aspect of the invention apparatus is provided for applying a lotion, with the apparatus including a frame, a roller, and a clamshell cover. The frame includes an axle and a handle extending away from the axle. The roller includes a housing having a cylindrical peripheral surface and a porous cover extending over the cylindrical peripheral surface. The clamshell cover is removably fastened over the roller with the roller rotatably mounted on the axle.

BRIEF DESCRIPTION OF THE FIGURES

FIG. 1 is a perspective view of a lotion applicator built in accordance with the present invention;

FIG. 2 is a cross-sectional elevation of the lotion applicator of FIG. 1, taken as indicated by section lines 2-2 therein to show the internal construction of a roller therein built in accordance with a first embodiment of the invention;

FIG. 3 is an end view of the roller of FIG. 2;

FIG. 4 is a transverse cross-sectional elevation of the roller of FIG. 2, taken as indicated by section lines 4-4 therein;

FIG. 5 is a transverse cross-sectional elevation of an alternative version of the roller of FIG. 2;

DETAILED DESCRIPTION OF THE INVENTION

Figure 6:
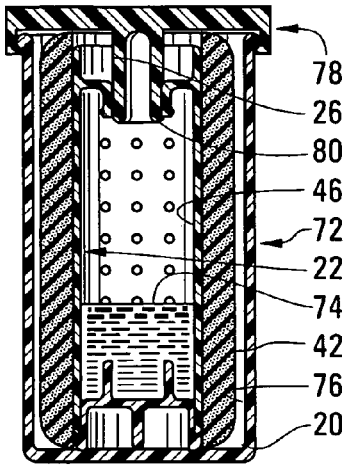
FIG. 6 is a longitudinal cross-sectional elevation of the roller of FIG. 2, removed from the applicator of FIG. 1 and held within a storage canister.

FIG. 1 is a perspective view of a lotion applicator 12 built in accordance with the present invention to include a frame 14 having an axle 16 and a handle 18 extending away from the axle 16, and additionally to include a roller 20 rotatably mounted on the axle 16.

FIG. 2 is a cross-sectional elevation of the lotion applicator 12, taken as indicated by section lines 2-2 in FIG. 1, to show the internal construction of the roller 20 as built in accordance with a first embodiment of the invention. The roller 20 includes a housing 22 having an inner end cap 24, forming an inner bearing 26 rotatably mounted on the axle 16, and a cylinder 28, extending in the outward direction indicated by arrow 30 from the inner end cap 24. The axle 16 extends to an end 32 disposed within the housing 22. The roller 20 additionally includes an outer end cap 34 having an outer surface 36 extending over the end 32 of the axle 16 and an inner surface 38 forming an outer bearing 40, which is spaced along the axle 16 from the inner bearing 26 in the outward direction of arrow 30. The roller 20 further includes a porous elastomeric cover 42 that is stretched over a peripheral surface 44 of the cylinder 28. For example, the elastomeric cover 42 is composed of hydrophilic urethane foam with small open cells.

The cylinder 28 includes a central cavity 46 and a plurality of holes 48 extending between the central cavity 46 and the peripheral surface 44. The outer end cap 34 is pressed into an end 50 of the housing 22, being thus attached to the housing 22 so that the outer bearing 40 turns with the housing 22. The end cap 34 is removable from the housing 22 to expose the central cavity 46, so that this cavity 46 can be filled with a lotion, such as a sunscreen. Then, as the roller 20 is rolled along the skin, lotion flows through the holes 48 into the porous elastomeric cover 42 and to the peripheral surface 52 of this cover 42, to be evenly applied to the skin.

FIG. 3 is an end view of the roller 20, particularly showing the outer end cap 34, which is provided with a cross-member 54 to facilitate the attachment and removal of the end cap 34 from the housing 22.

FIG. 4 is a transverse cross-sectional elevation of the roller 20, taken as indicated by section lines 4-4 to show the configuration of the holes 48 extending between the central cavity 46 and the peripheral surface 44 of the cylinder 28. As shown in the example of FIG. 4, all of these holes 48 are aligned in and opposite a first direction, as indicated by arrow 56, to facilitate the manufacture of the housing 22 by an injection molding process.

FIG. 5 is a transverse cross-sectional elevation of an alternative version 58 of a roller for use within the applicator 12. This alternative roller 58 includes a cylinder 60 having a second group of holes 62 aligned in and opposite a second direction, as indicated by arrow 64. The additional holes 62 provide for a more even application of lotion to the porous elastomeric cover 42 at the expense of a somewhat more complex mold for manufacturing an alternative roller housing 66. Other aspects of the alternative roller 58 are as described above for the roller 20.

Preferably, the lotion applicator 12 forms a part of apparatus for applying a lotion, such as a sunscreen, with the apparatus additionally including a device for covering the roller 20, so that this roller 20 can be stored while both the central cavity 46 and the porous elastomeric cover 42 are filled with lotion, with minimized levels of evaporation and contamination. For example, as shown in FIG. 2, the roller 20 is removably attached to be rotated on the axle 16 for storage, with a flexible detent ring 68 within a groove 70 in the axle 16 holding the roller 20 on the axle 16 in a manner allowing the roller 20 to be removed from the axle 16 in the outward direction of arrow 30 as the flexible detent ring 68 is compressed. The roller 20 is then reinstalled by being pushed onto the axle 16 opposite the direction of arrow 30, with the detent ring 68 again being compressed within the groove 70, and with a flange 71 on the axle 16 stopping movement of the roller 20 opposite the direction of arrow 30 when the roller 20 is fully installed on the axle 16.

FIG. 6 a longitudinal cross-sectional elevation of the roller 20, as removed from the applicator 12, being stored within a storage canister 72, to minimize the evaporation and contamination of lotion 74 within the central cavity 46 and of lotion held within the porous elastomeric cover 42. The storage canister 72 includes a storage cavity 76 for holding the roller 20, a storage end cap 78, removably attached to cover the storage cavity 76, and a plug 80 extending as a portion of the storage end cap 78 into the inner bearing 26 of the housing 22 to prevent leakage of the lotion 74 from the central cavity 46.

Figure 7:
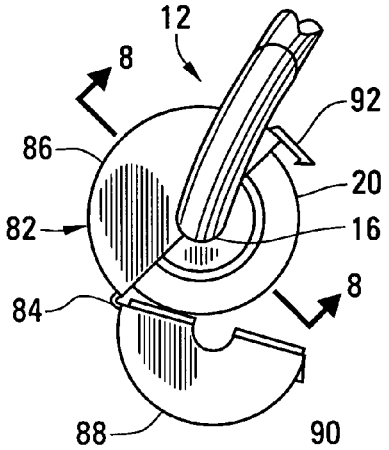
FIG. 7 is a fragmentary end view of the lotion applicator of FIG. 1 with an open clamshell cover placed over the roller therein.

FIG. 7 is a fragmentary end view of the lotion applicator 12 additionally including an open clamshell cover 82 placed over the roller 20 therein. The clamshell cover 82 can be installed over the roller 20 and removed from the roller 20 without removing the roller 20 from the applicator 12. The clamshell cover 82 includes a hinge 84 extending parallel to the axle 16 with the roller 20 being rotatably mounted on the axle 16. The hinge 84 pivotally attaches a first shell portion 86 within the clamshell cover 82 to a second shell portion 88.

Figure 8:
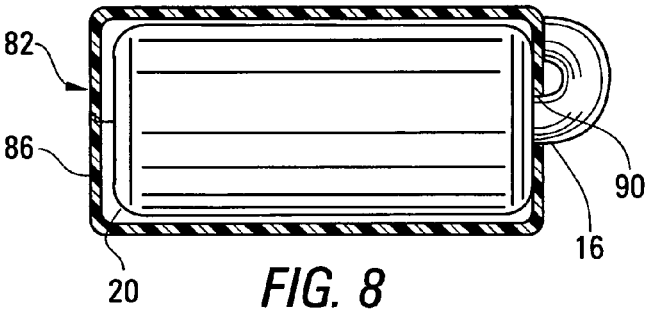
FIG. 8 is a fragmentary cross-sectional elevation of the lotion applicator and clamshell cover of FIG. 7, taken as indicated by section lines 8-8 therein, with the clamshell cover closed.

FIG. 8 is a fragmentary cross-sectional elevation of the lotion applicator 12 with the clamshell cover 82 in place thereon, taken as indicated by section lines 8-8 through the first shell portion 86, with the second shell portion 88 closed against the first shell portion 86. The shell portions 86, 88 each include a concave surface 90 that is disposed over the axle 16 with the clamshell cover 82 closed over the axle 16. The clamshell cover 82 additionally includes a latch 92 releasably holding the shell portions 86, 88 together at a side 94 of the clamshell cover 82 opposite the hinge 84.

Figure 9:
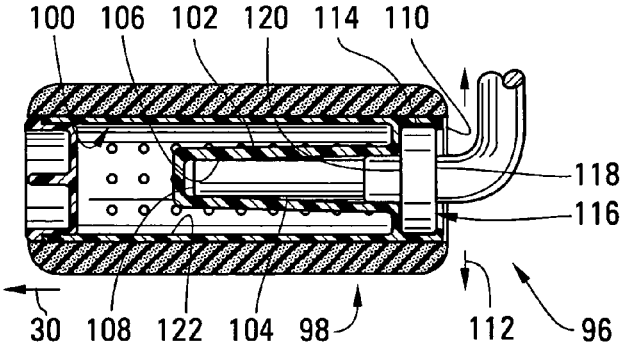
FIG. 9 is fragmentary cross-sectional elevation of a lotion applicator, showing the internal construction of a roller therein built in accordance with a second embodiment of the invention.

FIG. 9 is a fragmentary cross-sectional view of the lotion applicator 96, showing the internal construction of a roller 98 built in accordance with a second embodiment of the invention. The roller 98 includes a housing 100 having a central bearing structure 102 extending in the outward direction of arrow 30 to cover an axle 104 of the lotion applicator 96 and to forth an outer bearing 106 rotating on the axle 104. The axle 104 includes an end 108 disposed within the central bearing structure 102. The roller 98 is held in place on the axle 104 by a detent ring 110 forming a portion of the housing 100. The roller 98 is removed from the axle 104 by pulling in the outward direction of arrow 30, with the detent ring 104 moving radially outward, in the directions of arrows 112 to move over the peripheral surface 114 of a flange 116 attached to the axle 104. The roller 98 is reinstalled on the axle 104 by being moved opposite the direction of arrow 30 until such movement is stopped by contact between an end surface 118 of the housing 100 and an inner surface 120 of the flange 116. Alternately, the detent ring 104 may be divided into a number of individual elements extending around the housing 100. This roller configuration holds lotion within a central cavity 122 of the housing 100 out of contact with the axle 104. Other aspects of the roller 98 are as explained above in reference to FIGS. 1-5 regarding the roller 20, and other aspects of the lotion applicator 96 are as explained above in reference to the lotion applicator 12.

Figure 10:
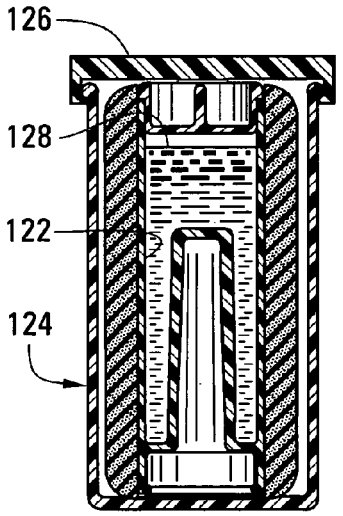
FIG. 10 is a longitudinal cross-sectional elevation of the roller of FIG. 9, removed from the applicator of FIG. 1 and held within a storage canister.

FIG. 10 is a longitudinal cross-sectional elevation of the roller 98, removed from the applicator 96 and held within a storage canister 124, which is similar to the storage canister 72, except that a plug extending from the storage lid 126 of the canister 124 is not required to prevent leakage of the lotion 128 held within the central cavity 122. Alternately, the roller 98 can be stored in the clamshell canister 82, described above in reference to FIGS. 7 and 8, without removing the roller 98 from the lotion applicator 96.

While the invention has been described in its preferred forms or embodiments with some degree of particularity, it is understood that this description has been given only by way of example, and that many variations can be made without departing from the spirit and scope of the invention, as defined in the appended claims.

What is claimed is:

1. Apparatus for applying a lotion comprising a frame including an axle extending from an outer end, a flexible detent, and a handle extending away from the axle;

a roller including a housing having an inner end cap with a bearing opening to be rotatably mounted on the axle and removably held on the axle by the flexible detent, with the roller extending over the outer end of the axle, wherein the housing includes a cylindrical peripheral surface, a central cavity for holding a lotion, and a plurality of holes extending between the central cavity and the cylindrical peripheral surface, wherein the roller additionally includes a porous elastomeric cover stretched over the cylindrical peripheral surface of the housing, and an outer end cap disposed at an outer end of the housing to seal the central cavity, and wherein the roller can be removed from the axle by simply pulling the roller off the axle; and a canister including a storage cavity for holding the roller when removed from the frame, including an opening for receiving the roller, and a canister cap sealing the opening for receiving the roller.

2. The apparatus of claim 1, wherein the porous elastomeric roller cover is composed of a hydrophilic urethane foam with small open cells.

3. The apparatus of claim 1, wherein the outer end cap is removable from the roller to expose the central cavity.

4. The apparatus of claim 3, wherein the roller housing additionally includes a central bearing structure extending in the outward direction to cover the axle within the central cavity and forming the outer bearing; and the axle includes an end disposed within the central bearing structure.

5. The apparatus of claim 4, additionally comprising a storage canister including a storage cavity for holding the roller housing with the roller cover stretched over the outer surface of the cylinder and a storage end cap removably attached to cover the storage cavity.

6. The apparatus of claim 1, wherein the bearing opening extends through the inner end cap to the central cavity, the outer end cap includes an internal surface forming an outer bearing rotatably mounted on the axle and covering an end of the axle; and the canister cap includes a plug sealing the bearing opening when the roller is held within the canister, preventing leakage from the central cavity.

7. A method for applying a lotion to skin and for storing a portion of the lotion between applications, comprising:

a) filling a central cavity in a housing within a roller with lotion, wherein the housing includes a cylindrical peripheral surface and a plurality of holes extending between the central cavity and the cylindrical peripheral surface, wherein the roller additionally includes a porous elastomeric cover stretched over the cylindrical peripheral surface, and wherein lotion moves through the plurality of holes from the central cavity to the porous elastomeric cover;

b) rolling the roller along the skin by means of a frame including an axle and a handle extending away from the axle; wherein the axle extends to an end within the roller, and wherein the roller is removably held on the axle by a flexible detent;

c) removing the roller from the frame by overcoming the flexible detent and pulling the roller off the frame, with a portion of the lotion remaining within the central cavity;

d) inserting the roller, with a portion of the lotion remaining within the central cavity, into a storage cavity within a canister separate from the frame, and e) sealing the storage cavity with a cap.

8. The method of claim 7, wherein the central cavity is filled by removing a front end cap sealing the central cavity in the housing;

pouring lotion into the central cavity with the roller held on the axle by the flexible detent, and replacing the front end cap to seal the central cavity in the housing.

9. The method of claim 8, additionally comprising:

f) opening the storage cavity by removing the cap;

g) removing the roller from the storage cavity;

h) sliding the roller onto the axle, into engagement with the flexible detent; and i) repeating step b).

* * * * *